US006908163B1

(12) United States Patent
Hebeler et al.

(10) Patent No.: US 6,908,163 B1
(45) Date of Patent: Jun. 21, 2005

(54) BUCKET ASSEMBLY FOR A REFRIGERATOR

(75) Inventors: Bradley Thomas Hebeler, Blue Grass, IA (US); Scott W. Leimkuehler, Swisher, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/757,506

(22) Filed: Jan. 15, 2004

(51) Int. Cl.[7] ..... A47B 96/00
(52) U.S. Cl. ..... 312/405.1; 312/321.5
(58) Field of Search ..... 312/400, 401, 312/402, 405, 405.1, 408, 321.5; 62/377

(56) References Cited

U.S. PATENT DOCUMENTS

| | | | | |
|---|---|---|---|---|
| 2,012,262 A | | 8/1935 | Forsthoefel | |
| 2,576,691 A | * | 11/1951 | Money | 312/405.1 |
| 2,694,906 A | * | 11/1954 | Didion | 62/326 |
| 2,808,310 A | | 10/1957 | Patterson, Jr. | |
| 2,898,173 A | * | 8/1959 | Squire | 312/248 |
| 4,186,978 A | | 2/1980 | Thomson | |
| 4,775,201 A | | 10/1988 | Thomson | |
| 4,859,010 A | | 8/1989 | Jeziorowski | |
| 5,375,924 A | | 12/1994 | Pohl et al. | |
| 5,513,910 A | | 5/1996 | Ellingwood et al. | |
| 5,567,029 A | | 10/1996 | Haenisch et al. | |
| 2003/0020385 A1 | | 1/2003 | Leimkuchler et al. | |
| 2003/0020386 A1 | | 1/2003 | Leimkuchler et al. | |
| 2003/0080661 A1 | | 5/2003 | Ahmed et al. | |
| 2003/0102787 A1 | | 6/2003 | Whitaker et al. | |

FOREIGN PATENT DOCUMENTS

| | | | | |
|---|---|---|---|---|
| AU | 154076 | * | 11/1953 | 312/405.1 |
| DE | 222147 | * | 7/1962 | 312/321.5 |

* cited by examiner

*Primary Examiner*—James O. Hansen
(74) *Attorney, Agent, or Firm*—Diederiks & Whitelaw, PLC

(57) ABSTRACT

A bucket assembly for a refrigerator door includes a bucket frame and a bucket. The bucket frame includes a rear portion, opposing side portions and at least two mounting members. The mounting members detachably support the bucket frame on a plurality of support elements from an inner liner of the refrigerator door. The bucket includes a front wall, a back wall, a bottom wall, opposing side walls and a keeper element. The keeper element is provided to support the bucket on the bucket frame or, alternatively, respective ones of the plurality of support members. When supported on the bucket frame, the bucket is pivotable relative to the bucket frame. Therefore, the bucket can be selectively mounted for stationary or tilt-out modes of use depending upon whether or not the bucket frame is interposed between the bucket and the inner liner.

20 Claims, 4 Drawing Sheets

BUCKET ASSEMBLY FOR A REFRIGERATOR

BACKGROUND OF THE INVENTION

1. Field of the Invention

The present invention pertains to the art of refrigerators and, more particularly, to a storage unit in a refrigerator. The refrigerator storage unit of the invention takes the form of a bucket assembly that can either be tilted-out from, or be picked-off of, an inner liner of a refrigerator door.

2. Discussion of the Prior Art

It is known to provide the inner portion of a refrigerator door with stationary trays or bins for the storage of food products. It is also known, as demonstrated by U.S. Pat. No. 5,375,924, to provide mounting supports or ribs on a refrigerator door liner for mounting removable storage units. Readily removable storage units enable a consumer to maximize the use of available storage space in a refrigerator by positioning storage units in a manner that best accommodates a variety of food items. Although useful from an organizational standpoint, the retaining walls on these types of storage units may not adequately retain food items when the refrigerator door is being opened or shut. Obviously, the higher the retaining wall, the better the retention capabilities, but the more the view of the food items is obstructed.

Another known type of storage unit constitutes a storage bucket which is pivotally connected to a refrigerator door liner. Such a bucket is disclosed in U.S. Pat. No. 5,513,910. This type of storage unit has the advantage of retaining food items, while providing a relatively unobstructed view of and easy access to food items. However, the specific structure required for connecting the pivoting bucket to a refrigerator door liner prevents the bucket from being removed and readily interchanged with other types of storage units.

Another known storage unit is disclosed in U.S. Pat. No. 5,567,029 and takes the form of a removable shelf unit with a built-in retaining member. This arrangement advantageously prevents items supported by the storage unit from falling off due to abrupt movements of the refrigerator door, while also allowing a consumer to position the storage unit in a manner that best accommodates various food items.

Other arrangements, such as demonstrated by U.S. Patent Application Publication No. 2003/0020386, include a bucket frame or retainer that is mounted to refrigerator door liner. The retainer pivotally supports a removable bucket having structure specifically designed to engage with the retainer. The retainer is provided with a plurality of clips that engage with the bucket to prevent inadvertent tipping of the bucket when the refrigerator door is opened/closed.

Regardless of these known arrangements, there is considered to exist a need in the art for an extremely versatile removable storage system that allows consumers to further enhance the utilization of available storage space on a refrigerator door and that securely retains food items, while providing easy access to and an unobstructed view of the items.

SUMMARY OF THE INVENTION

The present invention is directed to a versatile bucket assembly for a refrigerator door. The bucket assembly includes a bucket designed to either be supported by a bucket frame attached to a refrigerator liner or directly to the refrigerator door liner. The bucket frame includes a rear portion, opposing side portions and at least two mounting members. Each of the opposing side portions is provided with an upwardly extending pivot element. The bucket frame is detachably mounted to the refrigerator door liner through the mounting members in a manner that enables the entire bucket frame to be readily picked-off the door liner. More specifically, the door liner is provided with a plurality of spaced support members that are adapted to receive the mounting members of the bucket frame so as to position the bucket frame at a select one of various vertical locations on the door liner.

In accordance with the most preferred form of the invention, the bucket includes a front wall, a bottom wall, a back wall and opposing side walls that collectively define a storage cavity. The bucket is also provided with a keeper element preferably arranged at an upper rear portion of each opposing side wall. The keeper element is designed to support, at least partially, the bucket on either the bucket frame or directly on the door liner. If the bucket is placed on the bucket frame, the bucket can tilt-out about a pivot axis defined by the keeper element to enhance access to articles stored in the bucket or selectively picked-off the bucket frame. In contrast, supporting the bucket directly on the door liner only allows the bucket to be picked-off the liner, rather than being tilted. Regardless of the position, a single bucket design can be used either for tilt-out storage or stationary/pick-off storage on the refrigerator door liner.

In further accordance with the present invention, the bucket assembly includes stop structure that limits the overall degree of rotation of the bucket about the pivot axis. The stop structure includes a stop surface and a travel limiter that abut one another to limit forward rotation of the bucket. Preferably, the stop surface is provided on at least one pivot element formed as part of the bucket frame and the travel limiter is provided on the keeper element. In this manner, when the bucket is pivoted about the pivot axis, the travel limiter abuts the stop surface on the pivot element(s) so as to enhance access to the storage cavity, while preventing the bucket from over-rotating which could cause spilling of articles stored in the bucket.

In still further accordance with the present invention, each of the opposing side portions of the bucket frame includes first, second and third lands, with the second land being raised relative to the first and third lands. With this arrangement, when the bucket is in an upright position, the keeper element rests on the first land. With the bucket supported on the first land, operation of the refrigerator door will not cause the bucket to tilt forward. Moreover, as the pivot axis is located forward of the first land and at an upper portion of the bucket, the possibility of the bucket inadvertently tilting forward upon operation of the door is substantially eliminated.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
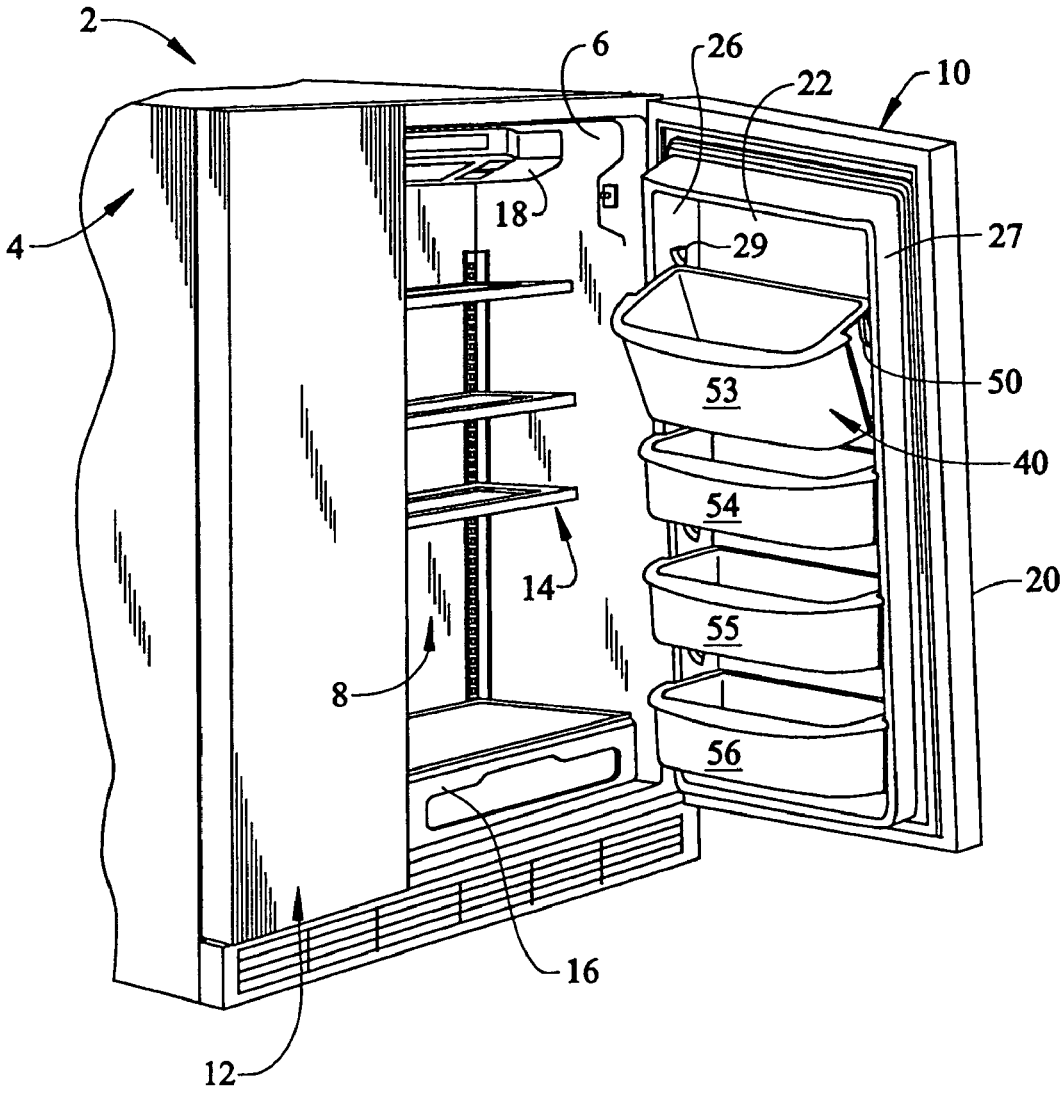
FIG. 1 is a partial, perspective view of a side-by-side refrigerator including a plurality of bucket assemblies constructed in accordance with the present invention mounted on an inner liner portion of a fresh food door of the refrigerator.

With initial reference to FIG. 1, a side-by-side refrigerator 2 is shown including a cabinet shell 4 within which is positioned a liner 6 that defines a fresh food compartment 8. In a manner known in the art, fresh food compartment 8 can be accessed by the selective opening of a fresh food door 10. In a similar manner, a freezer door 12 can be opened to selectively access a freezer compartment (not shown). In the embodiment shown, fresh food compartment 8 is provided with a plurality of vertically spaced shelves 14, along with a slidably mounted bin 16. Also illustrated in FIG. 1 is a control housing 18 arranged at an upper portion of fresh food compartment 8. In a manner known in the art, fresh food door 10 includes an outer shell 20 and an inner liner 22 including dike portions 26 and 27 integrally molded with a plurality of vertically spaced support members 29. In general, the basic structure of refrigerator 2 described above is known in the art and presented only for the sake of completeness. However, at this point, it should be realized that refrigerator 2 can take various forms known in the art without departing from the present invention as will be realized more fully below in discussing the specific aspects of the invention.

The present invention is particularly directed to a bucket assembly 40 arranged on inner liner 22 of fresh food door 10. Although FIG. 1 illustrates four such bucket assemblies 40, it should be realized that the actual number of bucket assemblies 40 can be readily varied. As shown, bucket assembly 40 includes a bucket frame 50 and bucket 53. However, while bucket 53 is shown mounted upon bucket frame 50, it should be understood that other correspondingly constructed buckets, such as those illustrated at 54–56, could be mounted directly to inner liner 22 of fresh food door 10. As will be detailed more fully below, positioning bucket 53 on bucket frame 50 provides a tilt-out storage unit to enhance access to articles stored in bucket 53. In contrast, bucket 53 could be attached directly to inner liner 22 through support elements 29 in a manner directly corresponding to buckets 54–56 to provide a stationary storage unit on fresh food door 10 that can be readily picked-off inner liner 22.

Figure 2:
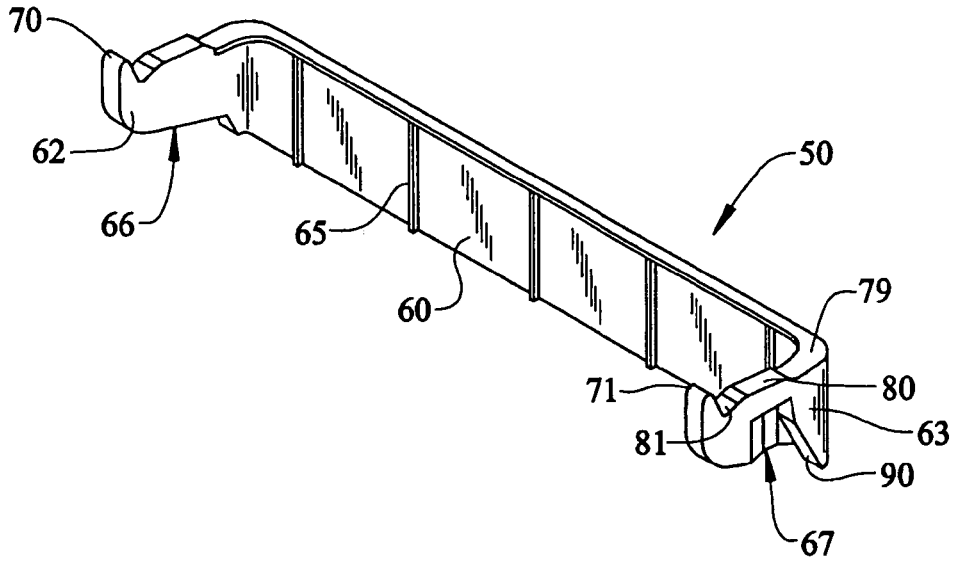
FIG. 2 is a perspective view of a bucket frame member of the bucket assembly of the present invention.
Figure 3:
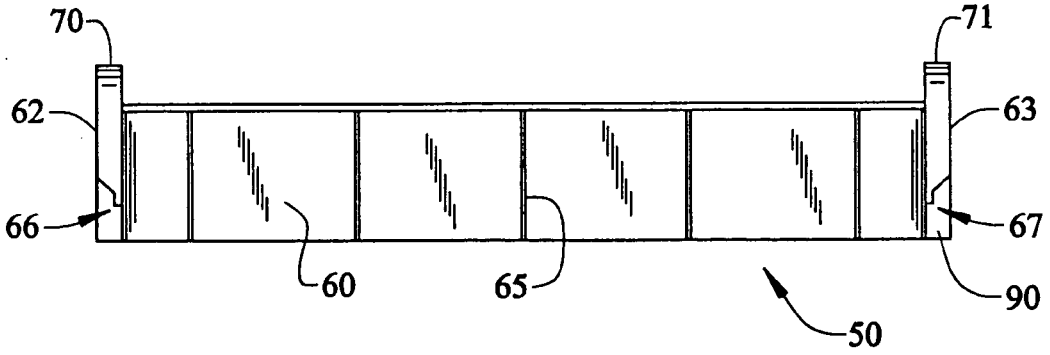
FIG. 3 is a front elevational view of the bucket frame member of FIG. 2.
Figure 4:
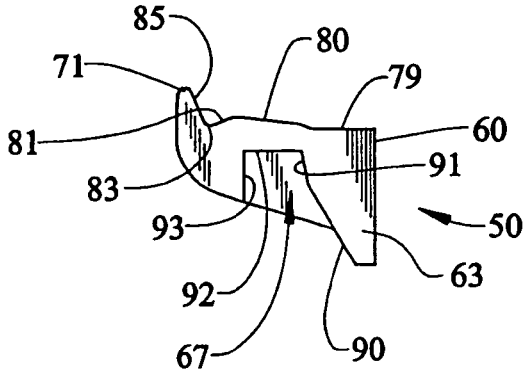
FIG. 4 is a side view of the bucket frame member of FIG. 2.

Referring to FIGS. 2–4, bucket frame 50 preferably includes a rear portion 60 and opposing side portions 62 and 63. In accordance with one aspect of the invention, opposing side portions 62 and 63 are integrally molded from plastic with rear portion 60 so as to define a unitary member. In addition, rear portion 60 is provided with a plurality of stiffener elements 65 that add to the overall structural stability of bucket frame 50. As further shown in these figures, each opposing side portion 62, 63 is provided with a corresponding mounting member 66, 67 which, as will be discussed more fully below, are adapted to engage with support members 29 to detachably secure bucket frame 50 to inner liner 22. Furthermore, each opposing side portion 62, 63 is provided with a corresponding pivot or hook element 70, 71 that projects generally upward so as to at least partially support bucket 53 as detailed below. In any event, as each opposing side portion 62, 63 is identically constructed, a detailed description will be made with respect to opposing side portion 63 with an understanding that side portion 62 has commensurate structure.

As best shown in FIG. 4, provided on an upper surface (not separately labeled) of opposing side portion 63 are a plurality of lands or distinct supporting surfaces 79–81. That is, opposing side portion 63 includes a first land 79 that extends to a second land 80 which, in turn, leads to a third land 81 that terminates at pivot element 71. Preferably, third land 81 is provided with a forward most angled portion 83. As will be detailed more fully below, angled portion 83, in combination with a stop surface 85 provided on each of pivot elements 70 and 71, limits an overall degree of pivoting of bucket 53 when tilted away from inner liner 22. As shown, second land 80 is preferably raised relative to first and third lands 79 and 81.

As described above, each opposing side portion 62, 63 is provided with a corresponding mounting member 66, 67. As each mounting member 66, 67 is identical, a description of mounting member 67 will be made with an understanding that mounting member 66 is similarly formed. With particular reference to FIG. 4, mounting member 67 is formed with a first angled portion 90 that extends toward a first, substantially vertical segment 91. First vertical segment 91 leads to a horizontal segment 92 that extends to a second, substantially vertical segment 93. With this overall geometry, mounting member 67 generally defines a recessed mounting zone which is constructed so as to engage with a respective one of the plurality of support members 29 to detachably support bucket frame 50 on fresh food door 10 in a manner that enables bucket frame 50 to be retained on, but readily picked-off of, inner liner 22.

Figure 5:
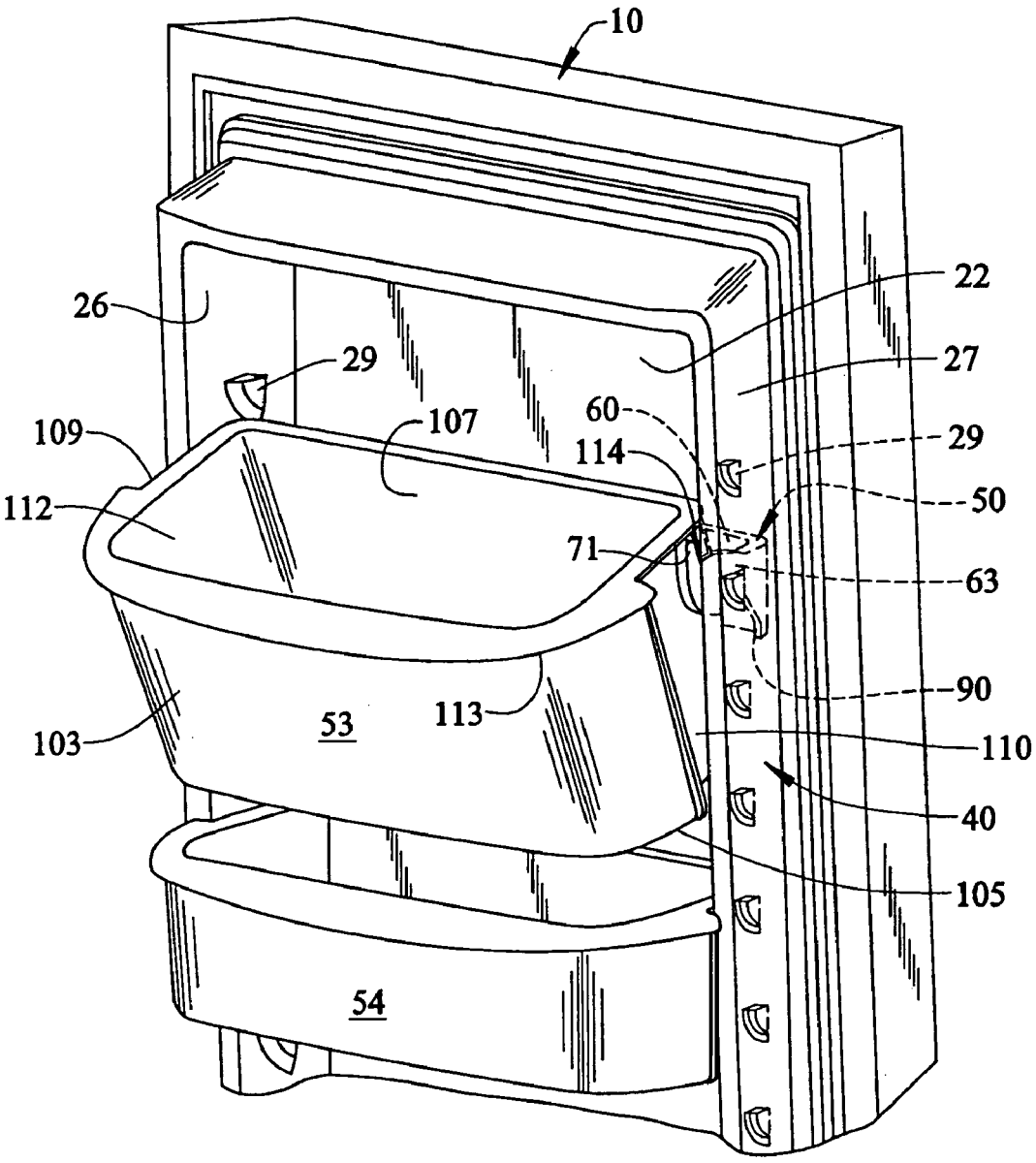
FIG. 5 is an enlarged partial perspective view of an inner liner portion of the refrigerator door of FIG. 1 depicting the bucket assembly of the present invention with a first bucket being supported by the bucket frame member of FIG. 2, and a second bucket being supported directly on the inner liner portion.
Figure 6:
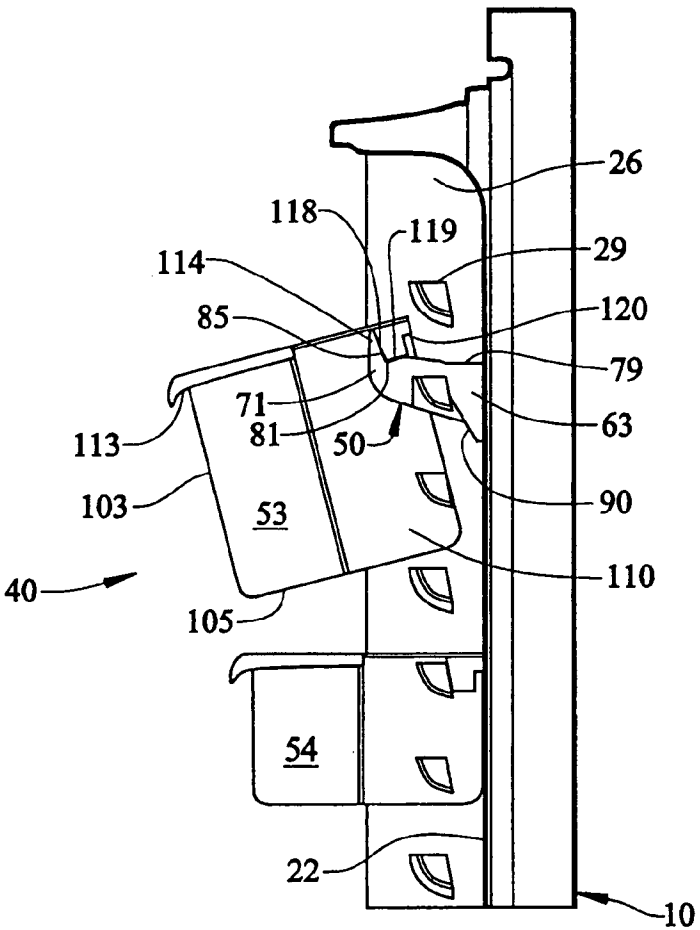
FIG. 6 is a side view of the refrigerator door of FIG. 5 depicting the first bucket in a tilt-out position.

Reference will now be made to FIGS. 1 and 5 in describing the particular configuration of buckets 53–56. Although buckets 53–56 can be sized or shaped differently, each bucket 53–56 is preferably identically constructed with respect to the structure thereof used to support the bucket 53–56 on inner liner 22. With this in mind, a detailed description of bucket 53 will be made and it is to be understood that buckets 54–56 have corresponding structure. As indicated above, bucket 53 is designed to be selectively mounted on inner liner 22 either through bucket frame 50 so as to be tiltable in order to enhance access to articles stored in bucket 53, or directly to fresh food door 10 through support elements 29. In any case, bucket 53 is shown to include a front wall 103, a bottom wall 105, a back or rear wall 107 and opposing side walls 109 and 110, all of which combine to collectively define a storage cavity 112. In addition, bucket 53 is provided with a peripheral lip or support flange 113 that extends across front wall 103 and along each of opposing side walls 109 and 110. As will be detailed more fully below, support flange 113 cooperates with pivot elements 70 and 71 of bucket frame 50 to support bucket 53 on inner liner 22. Bucket 53 is also provided with a pair of keeper elements, one of which is indicated at 114, positioned at an upper rear portion (not separately labeled) of each opposing side wall 109 and 110. Preferably, keeper elements 114 are integrally formed on opposing side walls 109 and 110. As best shown in FIG. 6, each keeper element 114 includes an angled frontal portion 118 that extends downward from support flange 113 and leads to a horizontal or support portion 119. As shown, support portion 119 returns upward to support flange 113 through a notched or offset portion 120. With this particular construction, angled portion 118 is designed to abut stop surface 85 on bucket frame 50 to limit the degree of pivoting of bucket 53 relative to bucket frame 50. Correspondingly, angled portion 118 is also constructed so as to nest between support member 29 and inner liner 22 if it is desired to mount bucket 53 in a stationary/pick-off mounting position, like buckets 54–56, on fresh food door 10.

Figure 7:
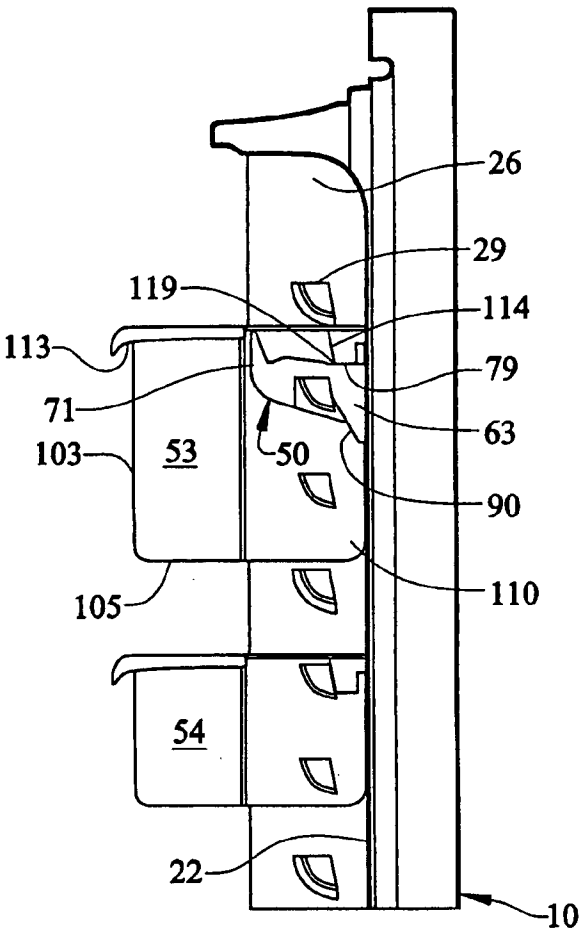
FIG. 7 is a side view of the refrigerator door of FIG. 5 depicting the first bucket in a home or retracted position.

As shown in FIGS. 6 and 7, bucket member 53, when supported by bucket frame 50, can be tilted-out away from inner liner 22 to enhance access to articles stored therein. That is, bucket 53 can be moved from a home position represented in FIG. 7, wherein keeper element 114 rests on first land 79 of side portion 63, to a tilt-out position represented in FIG. 6, wherein keeper element 114 rests within angled portion 83 of third land 81. As further represented in these figures, bucket 53 can be mounted directly to inner liner 22 through support elements 29 in a manner directly corresponding to bucket 54 by simply removing bucket frame 50. Thus, regardless of the particular support structure, a single bucket design can be utilized that can be tiltable, i.e. when mounted through bucket frame 50, or stationary relative to inner liner 22 when directly interconnected with respective support elements 29. Thus, the overall manufacturing costs associated with developing a versatile bucket assembly can be reduced while, at the same time, providing a flexible and unique storage system for refrigerator 2.

Although described with reference to a preferred embodiment of the present invention, it should be readily apparent to one of ordinary skill in the art that various changes and/or modifications can be made to the invention without departing from the spirit thereof. For instance, the particular shape of the bucket frame, bucket and support elements could be varied without departing from the scope of the present invention. Also, while the bucket assembly is described for use on the fresh food door of a side-by-side refrigerator, the bucket assembly could be employed on fresh food and/or freezer door liners of a wide range of refrigerators. In addition, while only one bucket frame is shown, multiple bucket frames could be provided. In general, the invention is only intended to be limited to the scope of the following claims.

We claim:

1. In a refrigerator having a door including an outer panel and an inner liner provided with a plurality of vertically spaced sets of support members, a bucket assembly for holding articles for refrigeration comprising:

a bucket frame including a rear portion, opposing side portions and at least two mounting members, each of the opposing side portions being provided with a pivot element, said bucket frame being detachably supported on the inner liner with the mounting members engaging a respective one of the plurality of vertically spaced sets of support members in a manner which enables the entire bucket frame to be readily picked-off the inner liner; and a bucket including a front wall, a bottom wall, a back wall, opposing side walls and keeper elements, each of the keeper elements being located at an upper rear portion of a respective one of the opposing side walls, said bucket being selectively mountable either directly upon the inner liner with the keeper elements engaging a set of the plurality of vertically spaced sets of support members to non-rotatably position the bucket on the inner liner while permitting the bucket to be readily picked-off the inner liner or with the keeper elements being positioned upon the bucket frame wherein the bucket is pivotable about a pivot axis defined between the keeper elements and the pivot elements to enable the bucket to be tilted relative to both the inner liner and the bucket frame to enhance access to articles stored in the bucket.

2. In a refrigerator having a door including an outer panel and an inner liner provided with a plurality of vertically spaced sets of support members, a bucket assembly for holding articles for refrigeration comprising:

a bucket frame including a rear portion, opposing side portions and at least two mounting members, each of the opposing side portions being provided with a pivot element, said bucket frame being supported on the inner liner with the mounting members engaging a respective one of the plurality of vertically spaced sets of support members; and a bucket including a front wall, a bottom wall, a back wall, opposing side walls and keeper elements, said bucket being selectively mountable either directly upon the inner liner with the keeper elements engaging a set of the plurality of vertically spaced sets of support members to non-rotatably position the bucket on the inner liner or with the keeper elements being positioned upon the bucket frame wherein the bucket is pivotable about a pivot axis defined between the keeper elements and the pivot elements to enable the bucket to be tilted relative to both the inner liner and the bucket frame to enhance access to articles stored in the bucket.

3. The bucket assembly according to claim 2, wherein each of the pivot elements projects upward from a respective one of the opposing side portions of the bucket frame.

4. The bucket assembly according to claim 3, wherein each of the pivot elements includes a first angled surface, a pivot surface and a second angled surface.

5. The bucket assembly according to claim 3, wherein each of the at least two mounting members includes an angled portion that facilitates mounting of the bucket frame to the inner liner.

6. The bucket assembly according to claim 3, wherein the bucket includes a support flange extending across the front wall and along at least a portion of each of the opposing side walls, said support flange being adapted to at least partially support the bucket on the pivot element when the bucket is placed in the bucket frame.

7. The bucket assembly according to claim 2, wherein each of the opposing side portions of the bucket frame includes a first land, a second land and a third land, said second land being raised relative to the first and third lands.

8. The bucket assembly according to claim 7, wherein each of the keeper elements is located at an upper rear portion of a respective one of the opposing side walls and is adapted to rest in the first land when the bucket is in an upright position.

9. The bucket assembly according to claim 8, wherein the third land includes an angled portion, each of said keeper elements being adapted to rest in the angled portion of a respective one of the opposing side walls to partially define a degree of pivoting of the bucket about the pivot axis relative to the bucket frame.

10. The bucket assembly according to claim 2, further comprising: stop means for limiting a permissible degree of pivoting of the bucket relative to the bucket frame, said stop means including a stop surface and a travel limiter.

11. The bucket assembly according to claim 10, wherein the stop surface is provided on the pivot element and the travel limiter is provided on the keeper element, said keeper element being adapted to abut the stop surface to limit a degree of pivoting of the bucket relative to the bucket frame.

12. The bucket assembly according to claim 2, wherein each of the keeper elements is located at an upper rear portion of a respective one of each of the opposing side walls.

13. The bucket assembly according to claim 12, wherein each of the plurality of support elements is spaced from a rear surface of the inner liner, said keeper element being sized to be positioned between the rear surface of the inner liner and the plurality of support elements to at least partially support the bucket when the bucket is placed directly on the inner liner.

14. In a refrigerator having a door including an outer panel and an inner liner provided with a plurality of vertically spaced sets of support members, a bucket assembly for holding articles for refrigeration comprising:

a bucket frame including a rear portion, opposing side portions and at least two mounting members, each of the opposing side portions being provided with a pivot element, said bucket frame being supported on the inner liner with the mounting members engaging a respective one of the plurality of vertically spaced sets of support members; and a bucket including a front wall, a bottom wall, a back wall, opposing side walls and keeper elements, each of the keeper elements being located at an upper rear portion of a respective one of the opposing side walls, said bucket being mounted with the keeper elements being positioned upon the bucket frame wherein the bucket is pivotable about a pivot axis defined between the keeper elements and the pivot elements to enable the bucket to be tilted relative to both the inner liner and the bucket frame to enhance access to articles stored in the bucket.

15. The bucket assembly according to claim 14, wherein each of the opposing side portions of the bucket frame includes a first land, a second land and a third land, said second land being raised relative to the first and third lands.

16. The bucket assembly according to claim 15, wherein the keeper element is adapted to rest in the first land when the bucket is in an upright position.

17. The bucket assembly according to claim 16, wherein the third land includes an angled portion, each of said keeper elements being adapted to rest in the angled portion of a respective one of the opposing side walls to partially define a degree of pivoting of the bucket about the pivot axis relative to the bucket frame.

18. The bucket assembly according to claim 14, wherein the bucket is adapted to be directly supported on the inner liner through the plurality of support elements, wherein said bucket is not pivotable about the pivot axis when the bucket is directly supported by the plurality of support elements.

19. The bucket assembly according to claim 14, further comprising: stop means for limiting a permissible degree of pivoting of the bucket relative to the bucket frame, said stop means including a stop surface provided on the bucket frame and a travel limiter provided on an upper rear portion of the bucket wherein, upon pivoting of the bucket relative to the bucket frame, the stop surface engages with the travel limiter to limit a degree of pivoting of the bucket relative to the bucket frame.

20. The bucket assembly according to claim 14, wherein the bucket frame is detachably supported on the inner liner in a manner which enables the entire bucket frame to be readily picked-off the inner liner.

* * * * *